United States Patent [19]

Philipp

[11] 4,157,527

[45] Jun. 5, 1979

[54] POLYCRYSTALLINE VARISTORS WITH REDUCED OVERSHOOT

[75] Inventor: Herbert R. Philipp, Scotia, N.Y.

[73] Assignee: General Electric Company, Schenectady, N.Y.

[21] Appl. No.: 843,793

[22] Filed: Oct. 20, 1977

[51] Int. Cl.[2] ..... H01C 7/10

[52] U.S. Cl. ..... 338/21

[58] Field of Search ..... 338/20, 21; 252/518; 29/610

[56] References Cited

U.S. PATENT DOCUMENTS

| | | | |
|---|---|---|---|
| 1,995,737 | 3/1935 | Everett | 338/21 X |
| 2,253,376 | 8/1941 | Johnson | 338/21 |
| 4,069,465 | 1/1978 | Kouchich et al. | 338/329 X |

*Primary Examiner*—C. L. Albritton

*Attorney, Agent, or Firm*—Lawrence D. Cutter; Joseph T. Cohen; Marvin Snyder

[57] ABSTRACT

A metal oxide varistor structure having a reduced voltage overshoot is disclosed. In accordance with one embodiment of the invention, the varistor disk, for example, is provided with a relatively small region of reduced thickness, the amount of said thickness reduction being dependent upon the original thickness of the varistor substrate. The area of region of reduced thickness is selected to control conduction duration in the region of reduced thickness.

10 Claims, 6 Drawing Figures

POLYCRYSTALLINE VARISTORS WITH REDUCED OVERSHOOT

BACKGROUND OF THE INVENTION

This invention relates to polycrystalline metal oxide varistors. More particularly, this invention relates to a novel configuration of polycrystalline metal oxide varistors in which the voltage overshoot, which occurs when the device is subjected to voltage pulses of extremely rapid rise time, is reduced.

The polycrystalline metal oxide varistor is a device which has a very non-linear voltage-current characteristic which makes it a very useful device for fixedly clamping the voltage across it and the device which it is to protect at a predetermined, safe value. That is to say, for voltage values below this clamping voltage, the device behaves like an ohmic resistor of very large value (as much as approximately 10,000 megohms) but when this clamping voltage is exceeded the device behaves like a low resistance conductor. The current voltage relationship which exists in these devices is expressed by the following equation:

$$I = (V/C)^{\alpha}$$

where

I is the current flowing through the material,

V is the voltage across the material,

C is a constant which is a function of the physical dimensions of the body of the device, its composition, and the parameters of the process employed to form the body, and is a measure of the clamping voltage, and $\alpha$ is a constant for a given range of current and is a measure of the non-linearity of the resistance characteristic of the body.

Metal oxide varistors are sintered ceramics composed principally of zinc oxide with a mixture of various other metal oxides added. These other oxides are typically bismuth trioxide, cobalt trioxide, manganese dioxide, antimony trioxide, and tin dioxide, each being present to the extent of approximately one-half to one mol percent, the remainder of the material being zinc oxide. The powder is ground and pressed into the desired shape after which the material is sintered at a temperature of approximately 1,000° C. to 1,400° C. After this, electrodes are applied to faces of the material and circuit connection wires are attached to the surface electrodes. The materials and processes for making such devices are well known in the art and are described, for example, in U.S. Pat. No. 3,962,144, issued to Matsurra et al.

The metal oxide varistor, in many respects, is similar to a bidirectional Zener diode, in that when a voltage is applied in excess of a certain value, the characteristic resistance of the device decreases dramatically and conduction through the device occurs. This nonlinear conduction characteristic renders the metal oxide varistor an important element in a variety of protective circuit configurations.

One of the most important charateristics of the metal oxide varistor is the voltage at which clamping occurs, the so-called breakdown voltage of the device. It is this value that determines the degree of protection the device offers. The voltage pulses to which the varistor is subjected are characterized by their rise times. The rise time of such a pulse is defined here and in the electrical arts as the time it takes the waveform to rise from 10 percent to 90 percent of its peak value. Thus, it is also known that when voltage pulses having extremely short rise times (approximately 0.1 μsec. or less) are applied across the device, that there is a period during which the voltage is clamped not at the steady state clamping voltage value but rather at a voltage which can be as much as 30 percent in excess of this value. However, for rise times found in most varistor applications, that is, approximately 0.1 μsec., the voltage overshoot is typically in the range from 3 percent to 10 percent. For example, a varistor with a nominal clamping voltage of 600 volts, when subjected to a voltage pulse whose rise time is approximately 0.1 μsec., with a 30 percent overshoot, develops a voltage across the varistor of 780 volts which excess voltage persists for approximately 1 μsec. Hence, this overshoot is a highly undesirable characteristic, if for adequate circuit protection, the voltage across the protected device cannot exceed 600 volts for such a long duration.

Another important characteristic of metal oxide varistors is their upturn. That is to say, they do not exactly obey the current-voltage relationship expressed in the equation above, but rather at high levels of current the value of the exponent alpha becomes lower. This means that the voltage across the device increases faster than it otherwise would for higher values of current.

Another important characteristic of the metal oxide varistors is their leakage current. When a varistor is operating below its clamping or breakdown voltage, it should exhibit a high resistance characteristic which means that for a given voltage in this range, the current through the device should be minimal. Typically, the current that flows through the varistor at one-half of its clamping voltage is referred to as the leakage current.

It is well known in the art of varistor manufacture, that the clamping voltage of the varistor is determined by the number of intergranular boundaries between crystals of zinc oxide in the varistor substrate. These crystals range in size from between 5 and 50 microns, the typical grain size being approximately 25 microns. It is known that each such grain boundary contributes a clamping voltage of approximately 3 volts. Hence, a 5 millimeter slab of a sintered ceramic oxide varistor material possesses approximately 200 such grain boundaries on the average, assuming a grain size of 25 microns. This results in a clamping voltage of approximately 600 volts.

However, the overshoot problem still persists and if a sufficiently high and sufficiently fast voltage pulse occurs, an overshoot as large as 30 percent permits the voltage to rise up to a level of 780 volts, depending on composition and the rate of rise, with more typical values of overshoot being in the range of from 3 percent to 10 percent.

SUMMARY OF THE INVENTION

In accordance with one embodiment of the present invention, a typical varistor shape such as a disk, cylinder, or slug is provided with a relatively small area of reduced thickness.

It is this area of reduced thickness which produces the desired electrical properties. Since the areas of reduced thickness which are provided have a lower clamping voltage, they are the first areas to conduct current upon the application of a sufficiently high voltage pulse. Nevertheless, these areas of reduced thickness are also subject to the overshoot phenomenon. However, the areas of reduced thickness are chosen to be thin enough so that the normal clamping voltage of the thinner area plus its associated overshoot voltage value is comparable to or greater than the nominal clamping voltage value of the thicker areas of the varistor. Several preferred embodiments are described which provide the appropriate areas of reduced thickness. One preferred embodiment for example provides for a varistor disk with beveled edges. Another provides for a dish-shaped recess in the surface of the varistor material. Other embodiments describe recesses with either triangular or rectangular cross sections. A single such recess or a plurality of them may be provided, if desired. These recesses may be provided, for example, during the pressing process for the varistor powder mix.

It is therefore an object of this invention to provide a metal oxide varistor structure exhibiting a reduced or eliminated voltage overshoot beyond the nominal clamping voltage of the varistor.

DETAILED DESCRIPTION OF THE INVENTION

Figure 1:
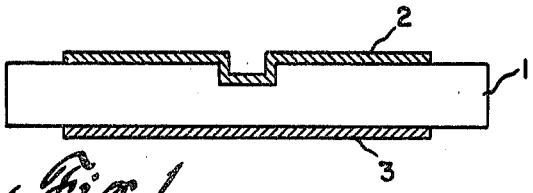
FIG. 1 is a cross-sectional view of a varistor constructed in accordance with the present invention, in which the area of reduced thickness has a substantially rectangular cross section.

FIG. 1 shows, by way of example, a preferred embodiment of the novel varistor configuration in which the recessed area provided is centrally located in the varistor surface and is substantially of uniform depth. It is easiest to understand the operation of the novel configuration disclosed herein in this embodiment. It is known that the breakdown voltage of the varistor is proportional to its thickness. It is also known that the varistor material is subject to a certain percentage of voltage overshoot under conditions described above.

Figure 6:
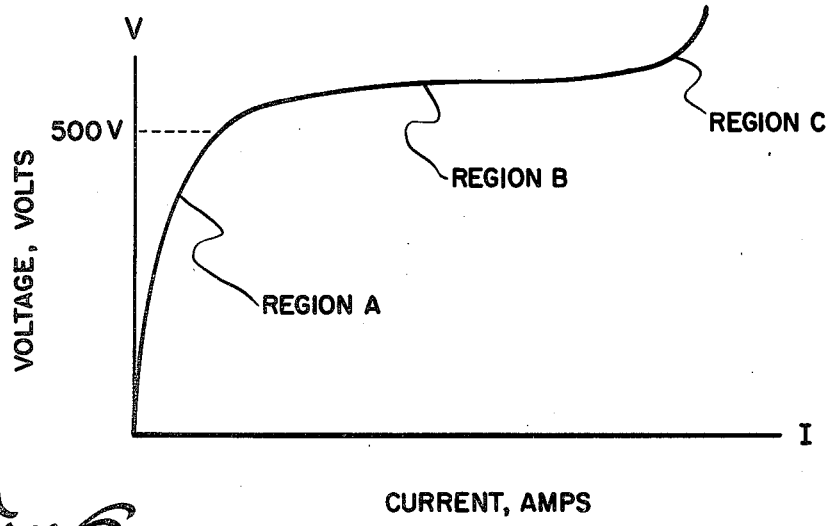
FIG. 6 is a graph of the voltage current characteristic of a typical varistor, plotted on a log-log scale, showing the three-operating regions of a typical varistor device and the clamping voltage.

The basic operation of the device as shown in FIG. 1 is now discussed. When a sufficiently high, sufficiently fast voltage pulse is applied across the varistor of FIG. 1, conduction occurs across the area of reduced thickness because this area has a lower breakdown voltage. This occurs at a voltage which is lower than the nominal breakdown voltage for the ceramic varistor material. In addition, there is a voltage overshoot across this region of reduce thickness. If desired, the thickness of the recessed area of the device is chosen so that the overshoot voltage that it experiences is less than the nominal breakdown voltage of the over-all device. It is in this manner that the novel structure serves to eliminate or reduce the voltage overshoot which occurs. All of the current during this initial period is conducted through the region of reduced thickness. Typically, however, the voltage pulse which is to be protected against has a value in excess of this nominal breakdown voltage. Hence, as the current density through the region of reduced thickness increases, the operating point of the device moves into region C as shown in FIG. 6, which is called the upturn region. After a time, depending upon the magnitude, duration, and rise time of the voltage pulse to be protected against, the voltage across the device increases to a value sufficient for conduction to occur across the whole device. By this time though the transient voltage overshoot is dissipated through the area of reduced thickness. In this manner, the novel structure takes advantage of the increased propensity of the area of reduced thickness to enter into the upturn region C (see FIG. 6) where increased current produces an increase in the voltage across the device. More particularly, it is the increase in current density which produces this propensity and the current density is additionally controlled by the surface area of the recess provided. Thus, by providing a recess of a relatively small area, conduction across the whole device occurs earlier. Conversely, conduction across the whole device is delayed by increasing the area of the region of reduced thickness.

The novel configuration consists of a varistor with a recess of a particular depth, which recess is typically produced during the pressing process of varistor manufacture. The copending application of Lionel M. Levinson, Ser. No. 840,262 filed Oct. 7, 1977, which is assigned to the same assignee as this application, more particularly describes processes for the manufacture of varistors with recesses. In that application, recesses are provided for the purpose of manufacturing varistors with a low breakdown voltage without loss of mechanical integrity, which otherwise occurs when the thickness of the varistor ceramic is less than 0.5 millimeters. In this copending application, recesses are provided by chemical etching, mechanical drilling and adaptations of the pressing process. The copending application does not, however deal with the problem of voltage overshoot. In particular, it does not describe the depth control of the recess needed for reducing or eliminating the voltage overshoot.

It is to be noted that the design of this varistor structure is such as to facilitate conduction across the whole device during all of its typical protective functioning except during the period of the transient voltage overshoot. It is to be further noted that to the extent described above and as shown in FIG. 6, this device depends for its operation on the varistor material having a characteristic upturn.

Let the fractional overshoot be called q, and let p be the fractional reduction required in the thickness of the varistor ceramic. The relationship between p and q is now discussed. If it is desired that the overshoot voltage across the region of reduced thickness be equal to the nominal breakdown voltage of the over-all device, namely, the breakdown clamping voltage of the thicker region, b, then the relation between p, the fractional reduction in thickness, and q the fraction of voltage overshoot occurring in both regions, is given by the following formula:

$p = q/(1 + q)$.

If this amount of thickness reduction is used, then the voltage overshoot is entirely eliminated. If a lesser amount of thickness reduction is used, the voltage overshoot is reduced but not eliminated. In addition, if the reduction in thickness is not as great as that provided by the above formula, the transition from conduction through the area of reduced thickness to conduction across the whole device occurs earlier.

For example, a varistor with nominal clamping voltage of 600 volts is typically 5 millimeters thick, assuming a varistor material composition having zinc oxide grains of approximately 25 microns. If this device experiences a 10 percent voltage overshoot, when subjected to a pulse with a 0.1 μsec. rise time, then this overshoot is eliminated by providing a fractional reduction of 0.091 (that is, 9.1 percent) yielding a 5 millimeter thick varistor with a relatively small recessed area of only 4.55 millimeters thickness, a reduction of only 0.45 millimeter.

A further advantage of the present structure is that the thinned area is in intimate thermal contact with the bulk of the varistor device and hence energy is dissipated throughout a much larger effective volume than just the volume occupied by the conducting thinned region. This larger effective volume for dissipating thermal energy is useful whenever conduction occurs through the region of reduced thickness and more particularly, it is useful if a voltage pulse occurs across the device at a level intermediate to the breakdown voltage level of the thinned region and the over-all breakdown voltage of the thicker region in which situation, only the thinned region conducts electrically; however, thermal conduction occurs throughout the entire volume. This configuration takes advantage of the generally excellent thermal conduction of zinc oxide. This enables the surface area of the reduced region to be kept relatively small (approximately 5 percent to 25 percent of the surface area of a single face).

FIGS. 1 through 5 show preferred embodiments of the invention. In all these embodiments there is a varistor body 1 in which there is provided a recess, thinned region, dimple, or bevel. The upper surface of these varistor bodies is provided with an electrode coating 2. The lower surface is also provided with an electrode coating 3. To these electode coatings are eventually attached wires for connection to external circuitry. Examples of electrode coating materials and methods of application are discussed in the copending application of Lionel M. Levinson, Ser. No. 840,262 filed Oct. 7, 1977.

Figure 2:
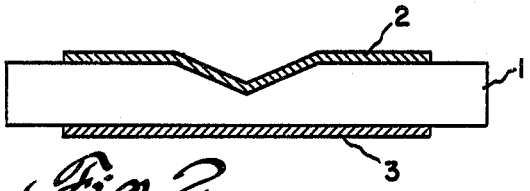
FIG. 2 is a cross-sectional view of a varistor constructed in accordance with the present invention in which the area of reduced thickness has a triangular cross section.

FIG. 2 is similar to FIG. 1 except that here the cross section of the recess is triangular in shape providing for a recess with sloping sides. In this configuration, conduction occurs first at the apex of the triangle where the thickness of the varistor ceramic is least and as the voltage increases, due to the extremely thin conducting region entering the upturn portion of its characteristic, conduction will spread to regions farther up the sloping sides further from the apex of the triangle. This provides for a more gradual shift from conduction through a narrow region to conduction across the whole device.

Figure 3:
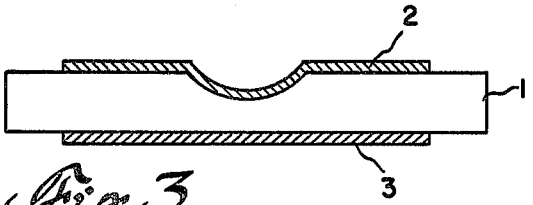
FIG. 3 is a cross-sectional view of a varistor constructed in accordance with the present invention having a dish shaped area of reduced thickness.

FIG. 3 is similar to FIG. 2 except that here the cross section of the recess is dish-shaped but the operation is similar.

Figure 4:
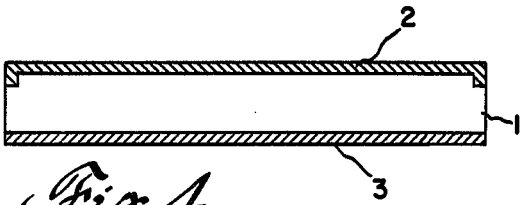
FIG. 4 is a cross-sectional view of a varistor constructed in accordance with the present invention in which the area of reduced thickness occurs at the edge of the varistor material and is otherwise rectangular in cross section.

FIG. 4 is similar to FIG. 1 in its manner of operation. However, here the recessed area is provided at the periphery of the varistor wafer.

Figure 5:
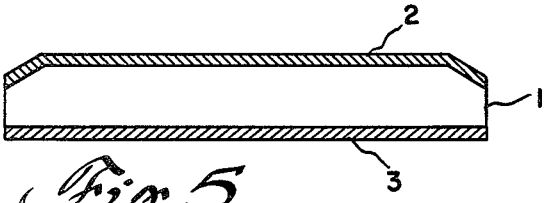
FIG. 5 is a cross-sectional view of a varistor construction in accordance with the present invention in which the area of reduced thickness is formed by beveling an edge.

FIG. 5 is similar to FIG. 4 in that the area of reduced thickness exists at the periphery of the varistor wafer but similar to FIG. 2 in that the recessed area is provided with sloping sides.

While the varistor material is typically formed into the shape of a round, circular disk, there is no need to limit its shape, in this dimension, for electrical reasons. If desired, a triangular, rectangular, elliptical, or other shape is suitable. These shapes are typically chosen to suit packing or other phsyical requirements.

The resultant varistor configuration permits the manufacture of devices with either a reduced or eliminated voltage overshoot. In this device, the thicker regions are electrically active and are not present solely for mechanical strength.

While this invention has been described with reference to particular embodiments and examples, other modifications and variations will occur to those skilled in the art in view of the above teachings. Accordingly, it should be understood that within the scope of the appended claims, the invention may be practiced otherwise than is specifically described.

The invention claimed is:

1. A polycrystalline metal oxide varistor body characterized by a breakdown voltage generally dependent on the thickness of said body, a portion of said body having a reduced thickness so as electrodes applied to said body are spaced apart nonuniformly, said thickness being effective to reduce voltage overshoot to a value less than the breakdown voltage of said thicker portion.

2. The varistor body of claim 1 wherein voltage overshoot is substantially eliminated by providing a fractional reduction in thickness, p, of said body, said fractional reduction being defined by $q/(1 + q)$ where q is the fractional voltage overshoot.

3. The varistor body of claim 2 in which q is less than 0.30.

4. The varistor of claim 1 in which the area of the region of reduced thickness is selected to provide for rapid transition to conduction throughout all regions of the varistor.

5. The varistor of claim 1 in which the area of the region of reduced thickness is selected to provide for absorption of the electrical energy in the expected voltage pulse.

6. The varistor of claim 1 in which the region of reduced thickness has a rectangular cross section.

7. The varistor of claim 1 in which the region of reduced thickness has a triangular cross section.

8. The varistor of claim 1 in which the region of reduced thickness has a dish-shaped cross section.

9. The varistor of claim 1 in which the region of reduced thickness is provided by a bevel at the periphery of the varistor wafer.

10. The varistor of claim 1 in which the region of reduced thickness is located at the periphery of the varistor wafer and has a rectangular cross section.

* * * * *